US006820316B2

(12) United States Patent
Rata

(10) Patent No.: US 6,820,316 B2
(45) Date of Patent: Nov. 23, 2004

(54) COMPOSITE BLADE AND A METHOD FOR ITS MANUFACTURE

(75) Inventor: Ilkka Rata, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 453 days.

(21) Appl. No.: 09/777,072

(22) Filed: Feb. 5, 2001

(65) Prior Publication Data

US 2001/0011401 A1 Aug. 9, 2001

(30) Foreign Application Priority Data

Feb. 8, 2000 (FI) ..... 20000254

(51) Int. Cl.[7] ..... B23P 17/00

(52) U.S. Cl. ..... 29/415; 29/412; 15/256.51; 162/281

(58) Field of Search ..... 15/256.51; 162/281; 29/412, 415, 417

(56) References Cited

U.S. PATENT DOCUMENTS

| | | | | | |
|---|---|---|---|---|---|
| 635,288 | A | * | 10/1899 | Barret | 29/415 |
| 2,645,816 | A | * | 7/1953 | Trussell | 29/415 |
| 2,987,748 | A | * | 6/1961 | Scott | 15/256.51 |
| 3,134,126 | A | * | 5/1964 | Phillips | 15/256.51 |
| 3,254,400 | A | * | 6/1966 | Gordon | 29/415 |
| 3,274,677 | A | * | 9/1966 | Kilbourn | 29/417 |
| 3,292,201 | A | * | 12/1966 | Bedard | 15/256.51 |
| 3,559,228 | A | * | 2/1971 | De Noyer | 15/256.51 |
| 3,930,445 | A | * | 1/1976 | Jaffa | 101/120 |
| 4,000,956 | A | | 1/1977 | Carlson et al. | |
| RE29,418 | E | * | 9/1977 | Hunt | 162/281 |
| 4,241,691 | A | | 12/1980 | Hopfe et al. | |
| 4,329,936 | A | * | 5/1982 | Heist et al. | 118/100 |
| 4,406,039 | A | * | 9/1983 | Hotz | 15/256.51 |
| 4,586,212 | A | * | 5/1986 | Gasser | 15/256.51 |
| 4,669,164 | A | * | 6/1987 | Phelps | 29/412 |
| 4,940,354 | A | * | 7/1990 | Holderegger et al. | 15/256.51 |
| 5,110,415 | A | | 5/1992 | Boucher et al. | |
| 5,759,680 | A | * | 6/1998 | Brooks et al. | 428/326 |
| 6,042,693 | A | * | 3/2000 | Marinack | 162/281 |
| 6,308,391 | B1 | * | 10/2001 | Blaimschein et al. | 29/412 |
| 6,491,754 | B1 | * | 12/2002 | Graf et al. | 118/123 |
| 2001/0052401 | A1 | * | 12/2001 | Kirjava et al. | 162/281 |

FOREIGN PATENT DOCUMENTS

| | | | |
|---|---|---|---|
| DE | 4421350 | | 12/1995 |
| DE | 19508298 | | 9/1996 |
| EP | 0 448 043 | A1 * | 9/1991 |
| EP | 0 454 404 | A1 * | 10/1991 |
| WO | WO 99/04091 | * | 1/1999 |
| WO | 9912726 | | 3/1999 |
| WO | WO 99/64674 | * | 12/1999 |

* cited by examiner

*Primary Examiner*—David P. Bryant
(74) *Attorney, Agent, or Firm*—Fildes & Outland, P.C.

(57) ABSTRACT

A composite blade, in which there is an essentially plate-like blade component with a composite-construction and retention members arranged in its rear part is intended to be installed in a special blade holder with the retention members remaining in the throat of the blade holder. The retention members are formed of a profiling arranged as a lateral extension of the blade component. The profiling extends essentially over the entire length of the blade and is of the same piece as the blade component.

3 Claims, 3 Drawing Sheets

COMPOSITE BLADE AND A METHOD FOR ITS MANUFACTURE

FIELD OF THE INVENTION

This invention relates to a composite blade, in which there is an essentially plate-like blade component with a composite-construction and retention members arranged in its rear part, which blade is intended to be installed in a special blade holder with the retention members remaining in the throat of the blade holder. The invention also relates to a method for manufacturing the blade.

BACKGROUND OF THE INVENTION

At present composite blades are used in, for example, the doctors of paper machines. Rivets are installed in such composite-construction doctor blades, as they are in metal doctor blades too. The rivets are mainly intended to prevent the doctor blade from falling out of the blade holder. In addition, the rivets hold the doctor blade at the correct angle and in the correct position in the blade holder.

However, rivetting is a difficult and time-consuming stage of work, requiring special tools. In addition, before rivetting, holes must be made in the doctor blade, which is also laborious. Usually metal rivets are used, which must, however, be removed when the doctor blade is recycled or otherwise reused. Metal rivets also tend to jam during both installation and removal while they also scratch the blade holder. A scratched blade holder dirties more easily and aggravates the jamming of the metal rivets. Metal rivets or parts of them can also fall into the process and find their way into a roll nip, for example, with destructive consequences.

SUMMARY OF THE INVENTION

An object of the invention is to create a composite blade, which is simpler and more user-friendly than before, and which avoids the drawbacks of the state of the art. The invention is also intended to create a method for manufacturing the said composite blade more economically and with fewer work stages.

More specifically, a composite blade, in which there is an essentially plate-like blade component with a composite-construction and retention members arranged in its rear part is intended to be installed in a special blade holder with the retention members remaining in the throat of the blade holder. The composite blade is characterized in that the retention members are formed of a profiling arranged as a lateral extension of the blade component, which profiling extends essentially over the entire length of the blade and which is of the same piece as the blade component.

In the blade according to the invention, the rivets are replaced with a new kind of retention member, which is of the same material as the blade itself. Thus, the retention members neither scratch the blade holder nor jam. In addition, according to the method the said retention members are also formed during the manufacture of the blade. This entirely eliminates the stage of installing a separate retention member. Other advantages of the blade and method according to the invention are described in greater detail in connection with the disclosure.

The method for manufacturing a composite blade, in which method an essentially plate-like blade component is formed from composite material, and retention members are arranged in the rear part of the blade component to retain the blade in the throat of a special blade holder, is characterized in that a unified blank is formed from composite material, to that both the blade component and the profiling forming the retention members are manufactured simultaneously, and from which blank the blade with its retention members is detached.

These and other features and advantages of the invention will be more fully understood from the following detailed description of the invention taken together with the accompanying drawings.

DETAILED DESCRIPTION OF THE INVENTION

Figure 1:
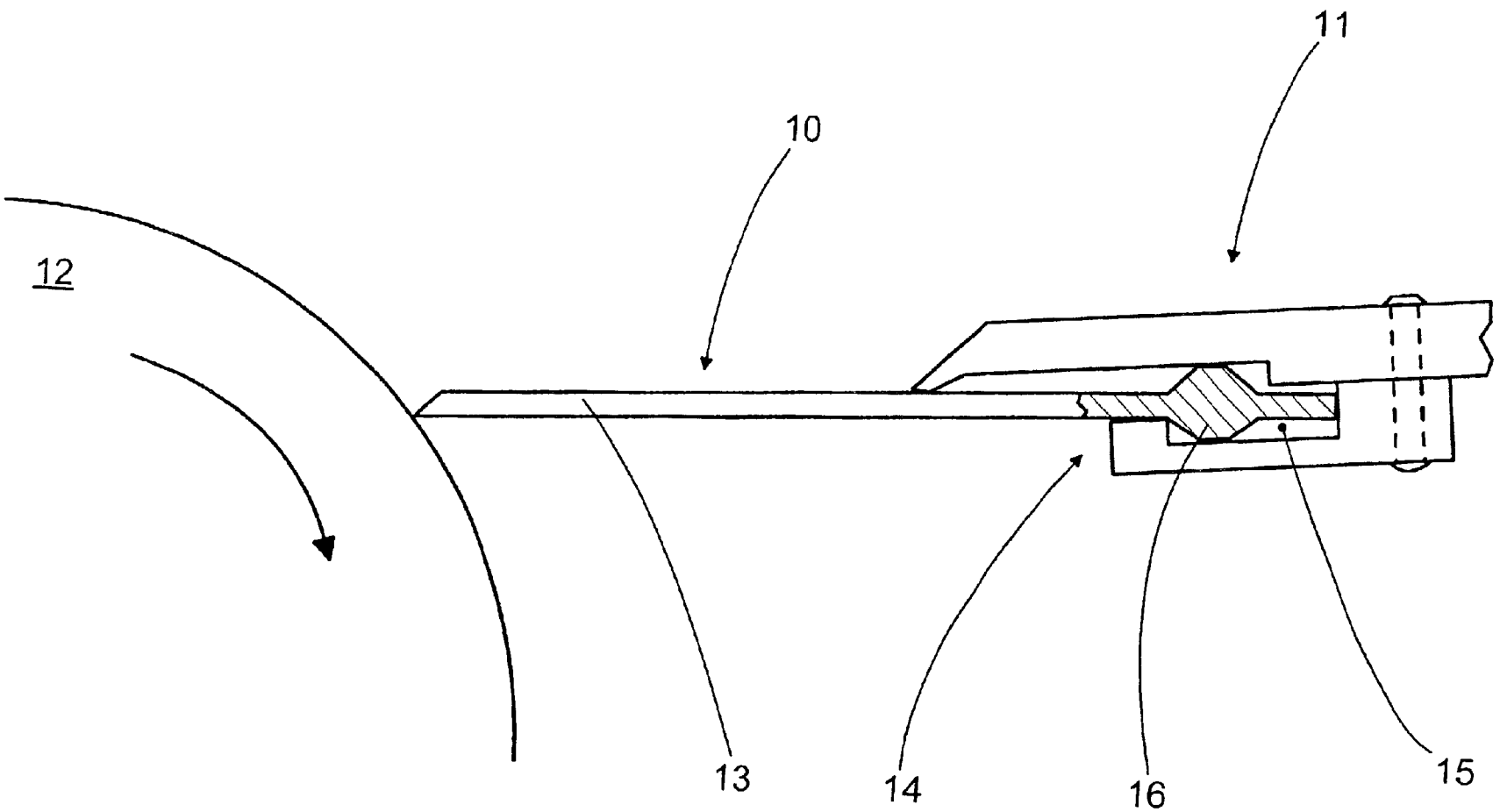
FIG. 1 shows a blade according to the invention installed in the blade holder of a doctor.

FIG. 1 shows a blade 10 according to the invention installed in the blade holder 11 of a doctor. Besides a doctor, the blade according to the invention can be used, for instance, in coating equipment or in other similar places. In this case, the surface of the roll 12 is doctored by the blade 10, which is installed in the blade holder 11 forming a part of the doctor. FIG. 1 shows only a part of the blade holder 11.

The blade 10 is generally manufactured from a composite material and includes an essentially plate-like blade component 13. In addition, retention members, which remain in the throat 15 of the blade holder 11 and thus prevent the blade 10 from falling out of the blade holder 11, are arranged in the rear part 14 of the blade component 13. According to the invention, the retention members form a profiling 16 arranged as a transverse continuation of the blade component 13, which extends essentially over the entire length of the blade 10 and which is of the same piece as the blade component 13. Thus the blade has no separate parts, which could detach and fall. In addition, profiling the composite material eliminates the scratching of the blade holder and the jamming associated with metal rivets. The profiling can also be easily shaped to correspond to the shape of the throat.

Figure 2A:
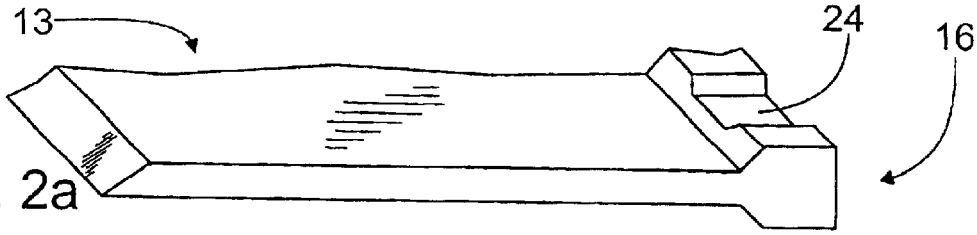
FIGS. 2*a*–2*d* show cross-sections of certain applications of the blade according to the invention.
Figure 2B:
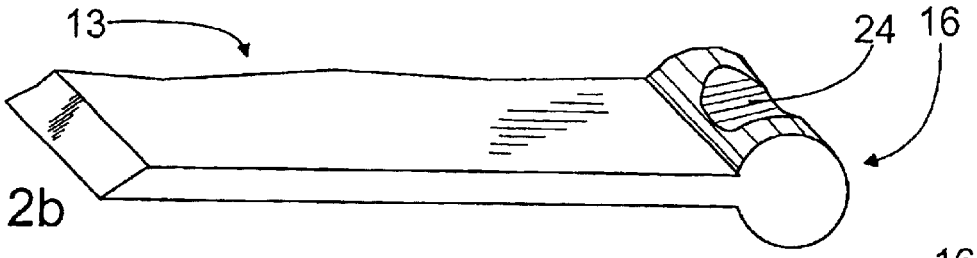

The shape of the profiling can be varied, depending on the blade holder and its throat. FIGS. 2*a*–2*e* show only a few different alternative shapes for the profiling. The same reference numbers are used for components that are functionally similar. In FIGS. 2*a* and 2*b* the profiling 16 has an essentially uniform cross-section. This creates a durable profiling, ensuring that the blade will remain in place. In addition, the profiling 16 extends to both sides of the blade component 13 over the thickness of the blade component 13. Blades of this kind are particularly suitable for use in traditional blade holders. However, one-sided profilings (not shown) can be used, for example, in a blade holder specially shaped for a blade according to the invention. The profiling 16 of FIG. 2*a* is angular, so that it will sit precisely in the throat of the blade holder. The profiling 16 of FIG. 2*b* h as an essentially round cross-section, allowing it to turn in the throat. In certain blade positions this is intentional.

Figure 2C:
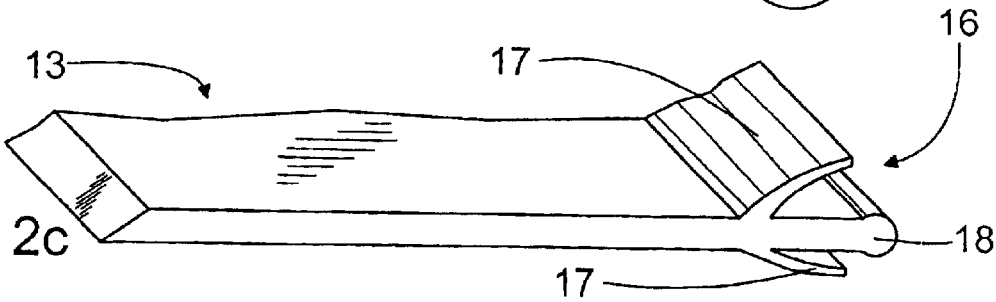
Figure 2D:
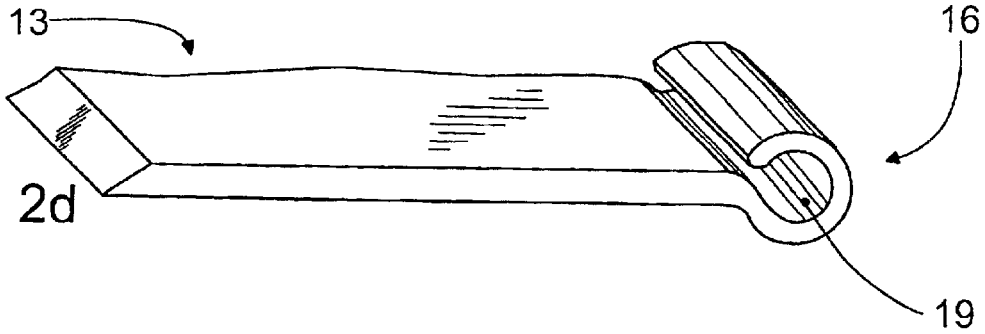

The blade can be given additional properties by giving the profiling a non-uniform cross-section and making the protruding parts of the profiling flexible. FIG. 2*c* shows this application, which has a profiling 16 with flexible strips 17 on each side of the blade component 13. This profiling 16 also has a protrusion 18 shaped in it, to act as a support and pivot point of the blade 10. These flexible properties can be used, for example, to keep the blade at a desired angle in the blade holder. Correspondingly, good flexibility can be achieved even in a rigid blade holder, if the blade is a flexible element.

Figure 2E:
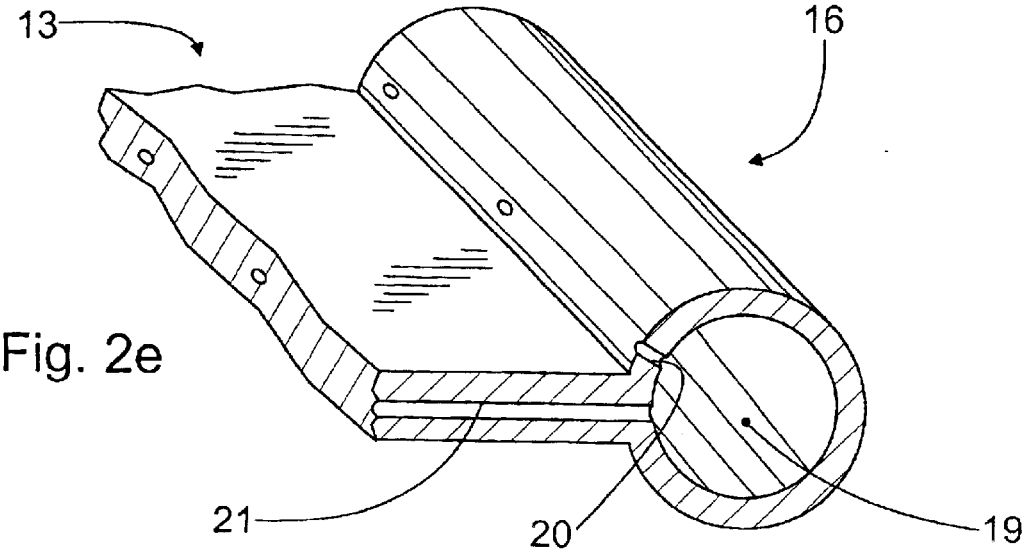
FIG. 2*e* shows another application of the blade of FIG. 2*d;*

In addition, the profiling can be shaped to create new properties in the blade. According to FIGS. 2*d* and 2*e* the profiling 16 has a hollow cross-section. This also allows the interior space 19 that is then formed to be used as a connection for a medium to the upper and/or lower side of the blade 10. The profiling 16 of FIG. 2*d* can also be made flexible. Thus, the profiling 16 can be used to conduct a medium over the full length of the blade component 13. The medium used can be air, a lubricating substance, or similar. In FIG. 2*e*, besides the profiling 16, holes 20, through which the substance is led onto the top of the blade component 13, are made at regular intervals, creating further opportunities to control the doctoring and increase its efficiency. For instance, the blade can be lubricated during the down running or air can be led from the holes to make doctoring more efficient. Similarly, the blade holder can be washed by a substance led from suitably placed holes. FIG. 2*e* also shows transverse holes 21 in blade component 13, through which a substance can be led to the edge of the blade. However, such holes 21 are more difficult to arrange than the holes 20 in the profiling 16. The operating properties referred to above make it advantageous to use a blade according to the invention precisely as the doctor blade of a doctor.

Figure 3A:
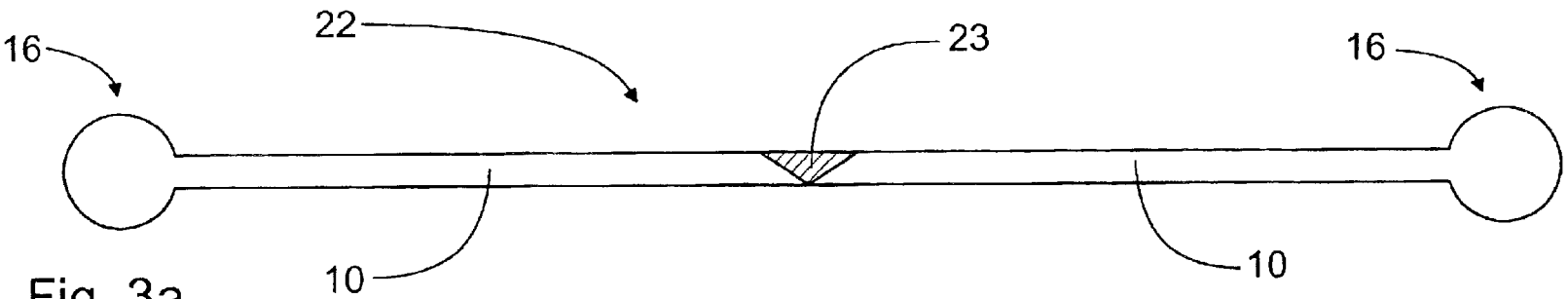
FIGS. 3*a*–3*b* show front views of two blanks according to the invention.
Figure 3B:
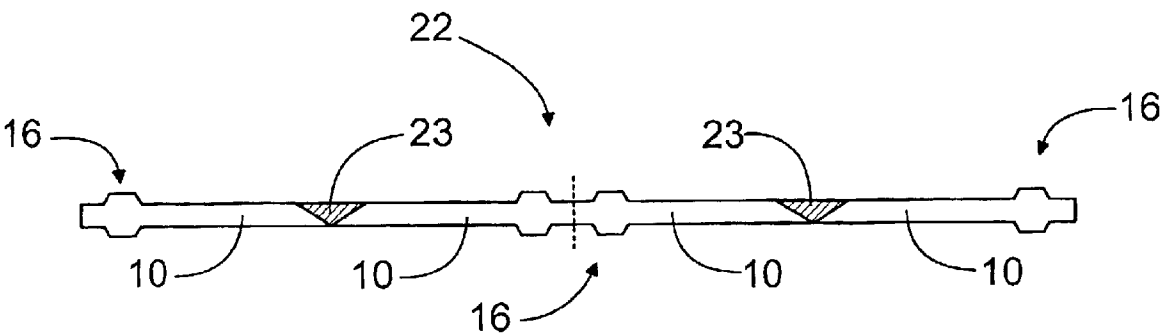
Figure 3C:
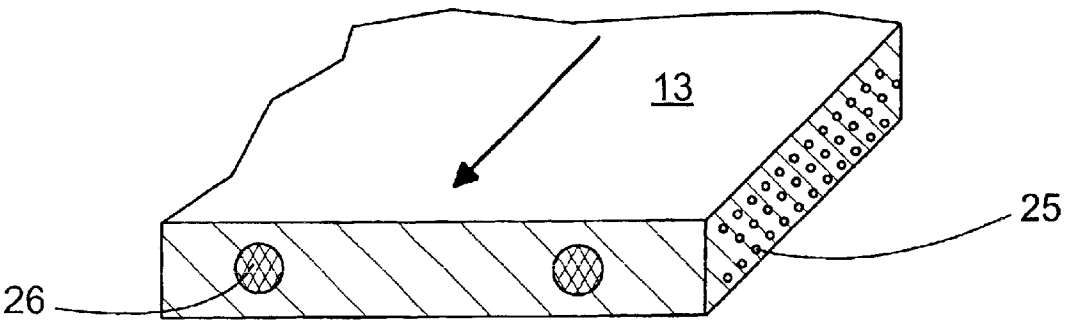
FIG. 3*c* shows partial cross-sections of the blade according to the invention in both the longitudinal and transverse directions.

In the manufacture of a blade according to the invention, a unified blank 22 is formed from a composite material, thus simultaneously forming both the blade component 13 and the profiling 16 forming the retention members. Thus, there is no need for a separate stage to attach the retention members. Finally the blade with its retention members is detached from the shaped blank 22. According to FIGS. 3*a* and 3*b*, two or more blades 10 and corresponding profiling 16 can be advantageously formed in a single blank 22. It is then simple to increase the number to be manufactured. The blanks 22 shown are preferably formed by pultrusion. This gives excellent shape and dimensional precision, eliminating the need to separately finish the blade. The profiling is created by adjusting the setting of the pultrusion device and the shape of the nozzle. Pultrusion also allows the orientation of the reinforcement fibers contained in the composite material. The reinforcing fibers 25 in the blade are preferably arranged essentially laterally in the blade 10 (FIG. 3*c*). This makes the blade rigid laterally but essentially flexible longitudinally. Thus the loading of the doctor, for example, is transmitted as well as possible to the doctor blade. On the other hand, a doctor blade that is flexible longitudinally adapts very well to the shapes of the surface being doctored. In addition, the reinforcing fibers effectively conduct heat away from the edge of the blade to the rest of the blade. Despite the preferred embodiment described above, the reinforcing fibers can in principle be oriented in nearly any direction at all. Usually, however, the orientation of the reinforcing fibers is nearly evenly divided between the lateral and longitudinal directions.

Pultrusion is thus used to achieve a blank with precise dimensions and shape, so that in principle the blades will be ready for use after being detached. In FIG. 3*a*, a single V-shaped saw cut 23 will not only detach blade 10 but also give its edge its characteristic shape. A simple cut will also create four blades 10 from the blank of FIG. 3*b*. FIG. 1 shows a corresponding blade. Blade detachment can be easily combined with the pultrusion device, so that an endless blade can be manufactured easily and quickly. In the same connection, a series of holes 24 or similar, arranged according to the blade-moving devices to be used, can be machined in the upper and/or lower surfaces of the profiling. Thus the blade can be moved using a crown-wheel with teeth that engage in the holes. In addition, the said holes make the blade more flexible, so that it can be rolled, for example, into a blade case or an automatic blade-changing device.

The aforesaid holes 24 also appear in FIGS. 2*a* and 2*b*. In addition to the reinforcing fibers 25, FIG. 3*c* shows the so-called traction fibers 26, which are generally glass-fibers, and which are used to pull the blank 22 through the nozzle (not shown). As pultrusion is, as such, a known technique, it is not described in this connection in any greater detail. The arrow shows the direction of the traction of the blank.

The method according to the invention avoids the need for separate rivetting work stages and equipment. In addition, manufacture of the blade is faster and more economical than before. Material waste is also reduced, as the thickenings required by the manufacturing technique can be exploited as profilings. The operation of a blade according to the invention will not scratch the blade holder, which is especially important when using composite blade holders. The reduction of scratching also reduces the dirtying of the blade holder, making it easier to keep clean. Parts also do not detach from the blade.

A blade according to the invention will not jam when being installed, making installation and removal faster and easier. Recycling of the blade is also easier, as the entire blade with its profiling is made from a single material. Materials sorting is not then required. The elimination of jamming is particularly important in connection with an automatic blade-changing device and with a blade box and recycling box. A lack of jamming is essential for the flexible and trouble-free operation of an automatic blade-changing device.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A method for manufacturing a composite blade, in which method an essentially plate-like blade component is formed from composite material, and retention members are arranged in the rear part of the blade component to retain the blade in the throat of a blade holder, characterized in that a unified blank is formed from composite material in which two mirror image blade components and opposite, spaced profilings forming the retention members for two or more blades are manufactured simultaneously, and from which unified blank the said two or more blade components with their retention members are detachable along a line spaced from and extending parallel to said opposite, spaced profilings.

2. A method according to claim 1, characterized in that the blank is formed by pultrusion.

3. A method according to claim 1, characterized in that holes are machined in the upper and/or lower surface of the profiling and arranged for a blade moving device to be used.

* * * * *